US006118228A

United States Patent [19]

Pál

[11] Patent Number: 6,118,228

[45] Date of Patent: Sep. 12, 2000

[54] ELECTRONIC BALLAST FOR FLUORESCENT LAMPS

[76] Inventor: Sándor Pál, Temesvar u. 20, H-1116 Budapest, Hungary

[21] Appl. No.: 09/043,972

[22] PCT Filed: Oct. 3, 1995

[86] PCT No.: PCT/HU95/00049

§ 371 Date: Apr. 2, 1998

§ 102(e) Date: Apr. 2, 1998

[87] PCT Pub. No.: WO97/13391

PCT Pub. Date: Apr. 10, 1997

[51] Int. Cl.[7] ..... G05F 1/00

[52] U.S. Cl. ..... 315/307; 315/291; 315/209 R; 315/244; 315/247; 315/DIG. 4; 315/DIG. 7

[58] Field of Search ..... 315/209 R, 307, 315/308, 291, 158, 226, DIG. 4, DIG. 7, 244, 247

[56] References Cited

U.S. PATENT DOCUMENTS 5,214,356 5/1993 Nilssen ..... 315/224
5,371,440 12/1994 Liu et al. ..... 315/209 R
5,402,043 3/1995 Nilssen ..... 315/307
5,519,289 5/1996 Katyl et al. ..... 315/224

*Primary Examiner*—Haissa Philogene
*Attorney, Agent, or Firm*—Venable; Gabor J. Kelemen

[57] ABSTRACT

A high-frequency filtered dimmable electronic ballast circuit for powering low-pressure fluorescent lamps includes an input protection device; a radio-frequency filter connected to an output of the input protection device; a rectifier connected to an output of the radio-frequency filter; a power factor correcting switching power supply device connected to an output of the rectifier; a current controlled push-pull converter connected to an output of the switching power supply device; a series-parallel resonant filter composed of a capacitor in series with two inductors having a common connection in parallel with an additional capacitor connected to an output of the push-pull converter to maintain voltage wave forms essentially sinusoidal and of constant amplitude regardless of loading; a fluorescent lamp connected to an output of the resonant filter; and an external on/off switching circuit connected directly or by an optical or magnetic insulation device to an input of the push-pull converter for renotely turning on and off the fluorescent lamp.

6 Claims, 4 Drawing Sheets

ELECTRONIC BALLAST FOR FLUORESCENT LAMPS

FIELD OF THE INVENTION

The present invention relates to the supply of power for fluorescent lamps. More specifically, the invention pertains to a high-frequency filtered and dimmable electronic ballast circuit for use with low-pressure fluorescent lamps. The circuit contains an input protection means, a radio-frequency filter means connected to the output of said protection means, a rectifier means connected to the output of said radio-frequency filter means, a power factor correcting switching power supply means connected to the output of said rectifier means, a current controlled push-pull converter means connected to the output of said switching power supply means, one or more series-parallel resonant filter means connected to the output of the said push-pull converter means and fluorescent lamp means connected to the output of said resonant filter means.

BACKGROUND OF THE INVENTION AND PRIOR ART

Low-pressure fluorescent tubes, so technical solutions for their electronical starting and powering are well known and have been widely used for several decades. Most of prior art solutions are designed and build as an ON/OFF (two-state) switch for the sake of simplicity and low-cost: the fluorescent lamp is either switched on or switched off and their light input intensity cannot be dimmed neither within ranges nor continuous.

Low-pressure fluorescent lamps and ballasts for their electrical starting and powering are well known technology and various types of fluorescent lamp and ballast combinations have been widely used for several decades. Most older magnetic ballasts contain passive components only, provide voltage outputs in the 50 Hz to 60 Hz frequency range are subject to start-up and running flicker and operate extremely inefficiently. Newer electronic ballasts utilize active electronic switching circuits, provide high-frequency voltage outputs in the 20 kHz to 50 kHz frequency range and operate more efficiently. However, most electronic ballasts are very simple in design, have insufficient input protection and radio-frequency filtering, operate at poor input power factors, inject large amounts of low-frequency harmonics back into the ac supply, have square-wave voltage outputs, utilize feed-back control to maintain the output voltage constant and are suitable only to operate in the ON/OFF mode (i.e.: non-dimming). Such ballasts eliminate start-up and running flicker but do not operate very reliably and, in addition, may cause severe reductions in lamp lifetimes since it is well known that one of the major causes of reduced lamp lifetime is the result of subjecting the lamp filaments to high-voltage square-wave excitation. Some of the latest types of electronic ballast designs have attempted keep the excitation quasi-sinusoidal by resonating the output square-waves with series resonant circuits. The load impedance of the lamp in such circuits is generally an integral part of the series resonant circuit and different ballasts are required to power fluorescent loads with different impedances. Output voltage is sensed and feedback is used to modulate the square-wave to maintain output voltage relatively constant during load impedance changes. If, during normal ON operation, a lamp load is removed from such a circuit, the output voltage across the remaining lamp and across the feedback circuit may become very high and result in the damage of the remaining lamp, the converter's electronic circuits and also pose a potential risk to the user.

As an example of latest technology, U.S. Pat. No. 4,933,605, discloses a high frequency dimmable electronic ballast circuit for low-pressure fluorescent lamps. The circuit has a dc power supply, a converter connected to the power supply for preparing a square-wave ac voltage, a series-resonant output circuit with the fluorescent lamp load connected directly in series (or via a transformer) with the resonant circuit. Accordingly, the lamp is an integral part of the resonance circuit used to force the waveform of the voltage between the lamp filaments to be quasi-sine wave in shape. The ballast uses feedback control to try to keep output voltage essentially constant and it is claimed that the ballast is capable of driving more than one fluorescent lamp. Although this ballast appears to provide significant advantages over most prior types, it is designed to operate correctly only with designated types of lamps and various different ballast must be used to supply different lamp types. In addition, since the lamps are active parts of the resonance circuit, if lamp impedances increase the peak values of the voltage between the filaments will also tend to increase. Impedance increases due to aging may tend to accelerate the lamp aging process and the failure of one lamp may cause the other to also fail. In addition, removal of a lamp during normal ON operation may result in the generation of very high voltages that could cause damage to the remaining lamp and/or the converter circuit and may also be dangerous to the user.

It is the object of the present invention to provide a high-frequency dimmable electronic ballast that will operate consistently regardless of source and load changes and is suitable to power various types of fluorescent lamps. Further, during the design process, it was recognized that by ensuring a constant amplitude sinusoidal output regardless of loading and at the same time fully isolating the source from the load, high-voltage caused failures of the control circuits would be virtually eliminated. Accordingly, it is also the object of the present invention to provide a high-frequency dimmable electronic ballast that does not require feed-back from the output in order to maintain the output voltage constant. Finally, it is also the object of the present invention to provide a high-frequency dimmable electronic ballast capable of powering low-pressure fluorescent lamp loads while meeting all "state-of-the art" input and output requirements by providing input and output short circuit and overtemperature protection, reducing conducted and radiated radio-frequency interference (RFI), improving efficiency and input power factor, reducing input total harmonic distortion (THD) and limiting no-load output peak voltages. By meeting the above objectives this ballast will be easier and safer to use and will operate more reliably than other types presently available.

SUMMARY OF THE INVENTION

The basic invention provides a high-frequency filtered dimmable electronic ballast circuit for powering low-pressure fluorescent lamps, containing an input protection means, a radio-frequency filter means connected to the output of said protection means, a rectifier means connected to the output of said radio-frequency filter means, a power factor correcting switching power supply means connected to the output of said rectifier means, a current-controlled push-pull converter means connected to the output of said switching power supply means, a series-parallel resonant filter made up of a capacitor in series with two inductors with their common connection in parallel with another capacitor to make up a passive output filter to provide load independent sinusoidal output voltage without feedback means connected to the output of the said push-pull converter means and a fluorescent lamp means connected to the output of said resonant filter means.

In a first embodiment the current-controlled push-pull converter transformer TR2 is equipped with more than one secondary windings and more than one series-parallel resonant filters are used to power more than one fluorescent lamp simultaneously, In a second embodiment an external low voltage signal is connected directly to an input of the current-controlled push-pull converter in order to make dimming possible.

In a third embodiment an external low voltage signal is connected via optical insulation means to an input of the current-controlled push-pull converter in order to make dimming possible.

In a fourth embodiment an external low voltage signal is connected via magnetic insulation means to an input of the current-controlled push-pull converter in order to make dimming possible.

In a fifth embodiment an external ON/OFF switching circuit is connected directly or via optical or magnetic insulation means to an input of the current-controlled push-pull converter in order to turn the fluorescent lamps ON/OFF remotely.

Some of the novel features of the ballast design are as follows:

The ballast maintains its output voltages sinusoidal and constant regardless of input voltage and frequency variations or output load changes. Special series-parallel resonant output filters are used to maintain the voltage between the filaments constant and sinusoidal without the need for feedback voltage control. Accordingly, the ballasts may be used to power various types and combinations of lamps in areas where large input voltage and frequency variations are common.

The ballast can be used to control the light output intensity of whatever combination of lamps are connected to its output.

The ballast provides effective soft-starting to extend filament lifetimes and also allows the lamps to be dimmed to very low light output intensities. Isolated low-voltage windings are provided for the filaments of each lamp to ensure that some current will flow thorough them and they become preheated before the voltage between them becomes high enough to start current flow between them. The same windings also ensure that the peak values of the filament voltages are held essentially constant during dimming thereby allowing the lamps to be dimmed below 10% light output intensity.

The ballast is provided with an input power factor correction circuit that compensates for input voltage variations, minimizes input current harmonic distortion and maximizes input power factor and ballast efficiency. This feature ensures that, even if a large number of these ballasts are connected in parallel across the same supply, the supply and supply circuit breakers will not be adversely effected.

Input RFI filtering is provided in order to minimize conducted and radiated RFI. This feature is especially important when electronic ballasts are used close to noise sensitive electronic equipment such as RF receivers and computers.

The push-pull dc-to-ac converter circuit is operated in the current control mode. This helps to prevent switching transformer core flux unbalance and saturation which can result in increased current draw by the switching devices and excessive ballast temperature rise.

The temperature of the switching devices is sensed and the ballast is safely shut-down if the devices become overheated. The circuit can be reset by turning the input power off then back on. This feature allows the ballast to be safely used at ambient temperatures in excess of 45° C.

The ballast is protected against input and output short circuit, input voltage transients, input undervoltage and repetitive on/off/on switching. These features allow the ballast to operate safely especially in areas where supply failures and supply generated over and undervoltages are common.

The power factor correcting boost converter allows the ballast to operate from either ac of dc input voltage. This feature allows the ballasts to be used in locations where dc back-up is available and source transfer is provided.

BRIEF DESCRIPTION OF THE DRAWINGS

Reference may now be made for the following detailed description of a preferred embodiment of an electronic ballast circuit and its embodiments which were build up pursuant to the invention, taken in conjunction with the accompanying drawings, in which.

DETAILED DESCRIPTION OF A PREFERRED EMBODIMENT

Figure 1:
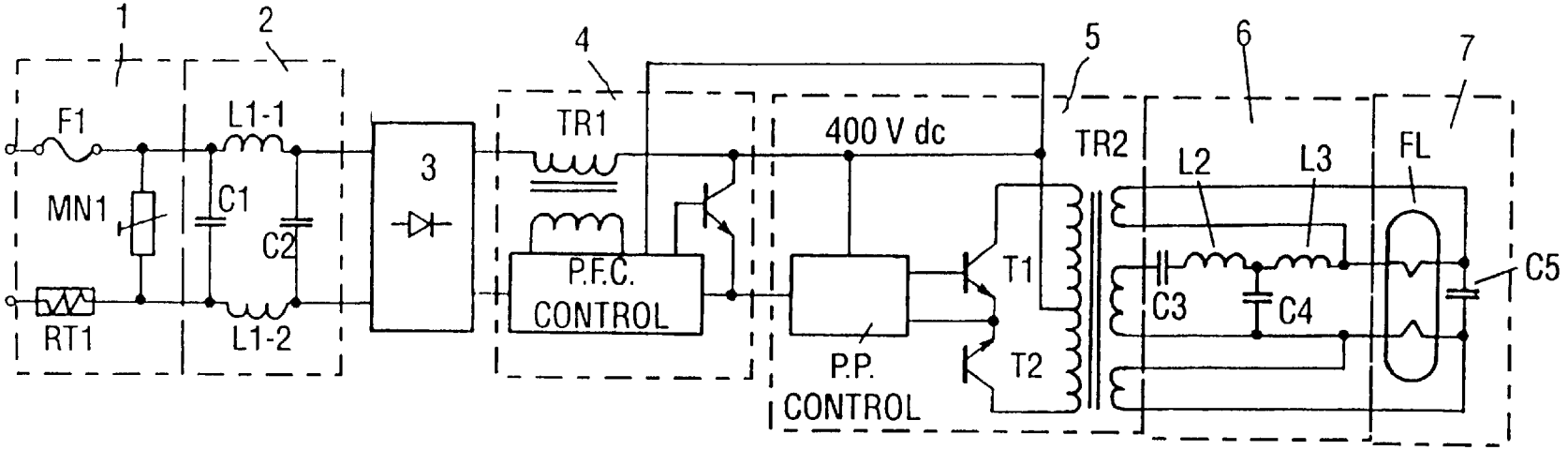
FIG. 1 illustrates a block diagram of a basic embodiment of the high-frequency dimmable electronic ballast circuit according to the invention.
Figure 7:
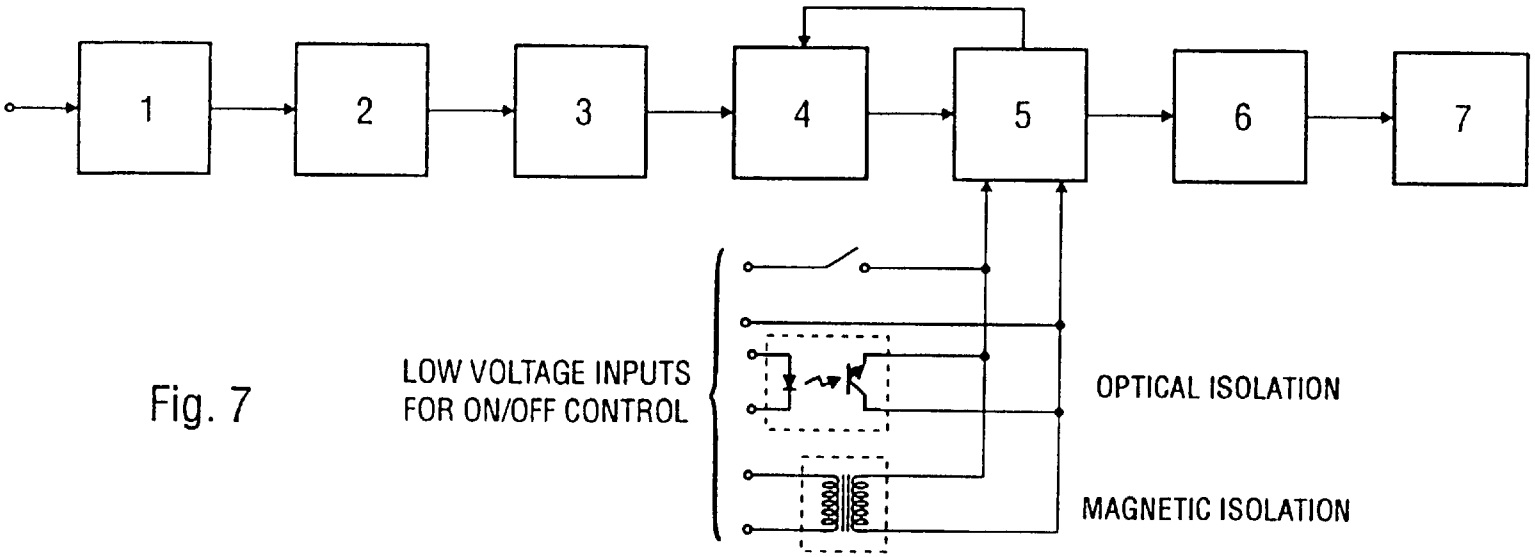
FIG. 7 illustrates the fifth embodiment of the invention in a similar format as FIG. 2.
Figure 2:
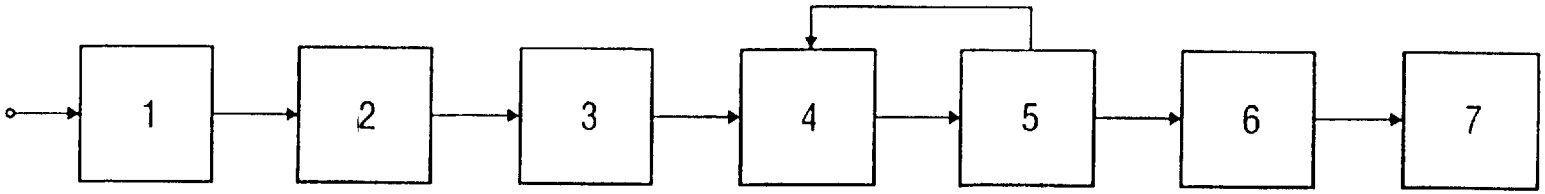
FIG. 2 illustrates a more reduced form of the block diagram in FIG. 1.
Figure 3:
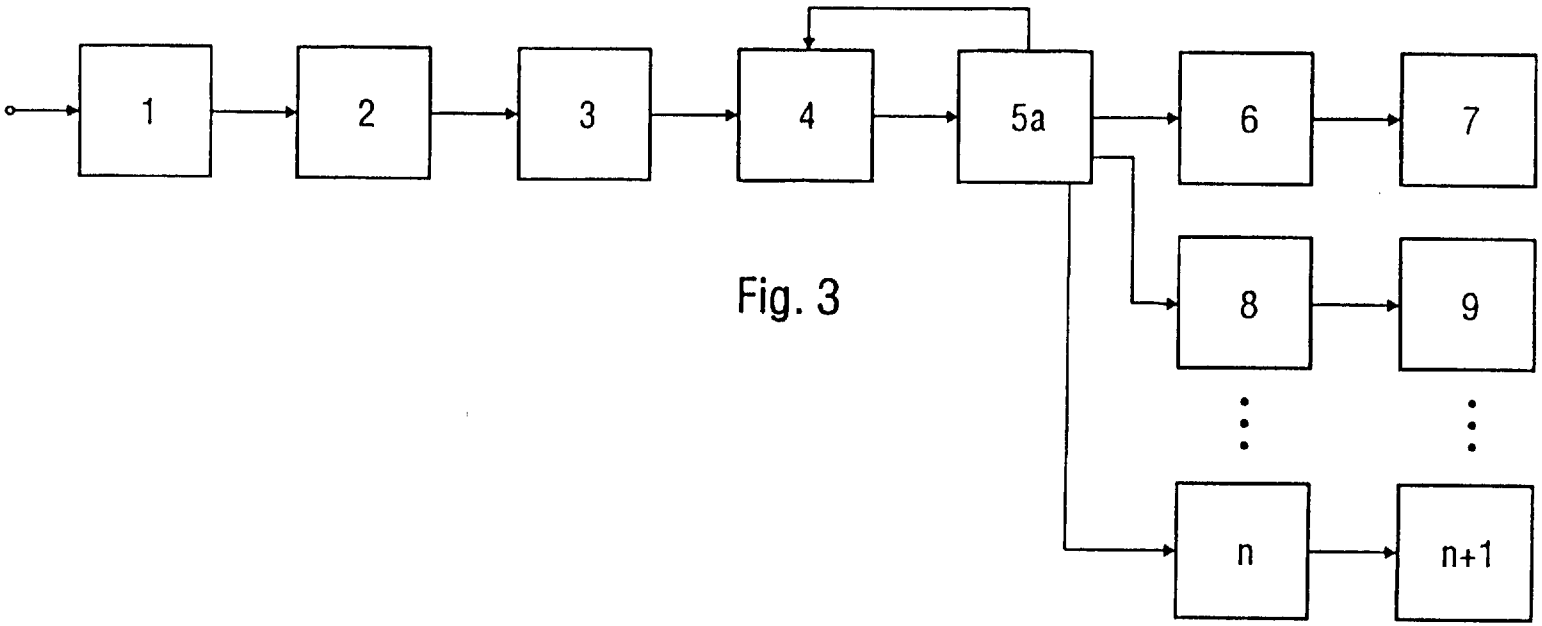
FIG. 3 illustrates the first embodiment of the invention in a similar format as FIG. 2.
Figure 4:
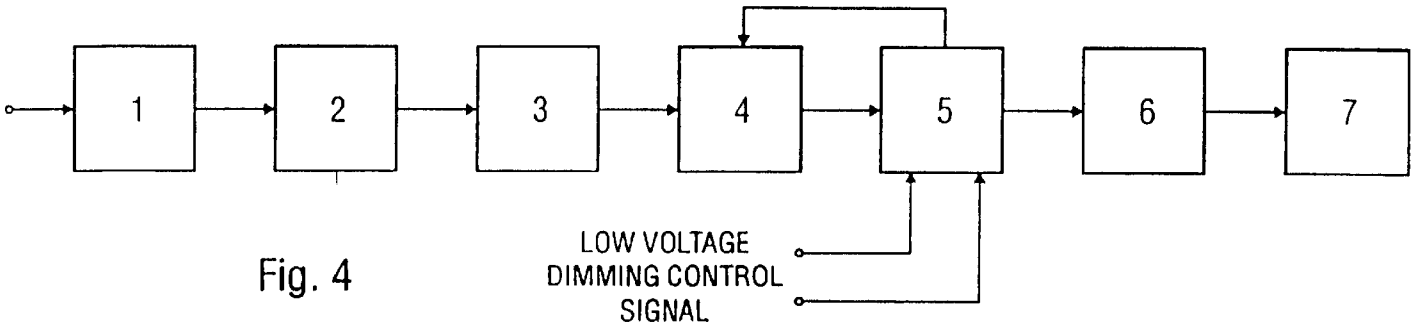
FIG. 4 illustrates the second embodiment of the invention in a similar format as FIG. 2.
Figure 5:
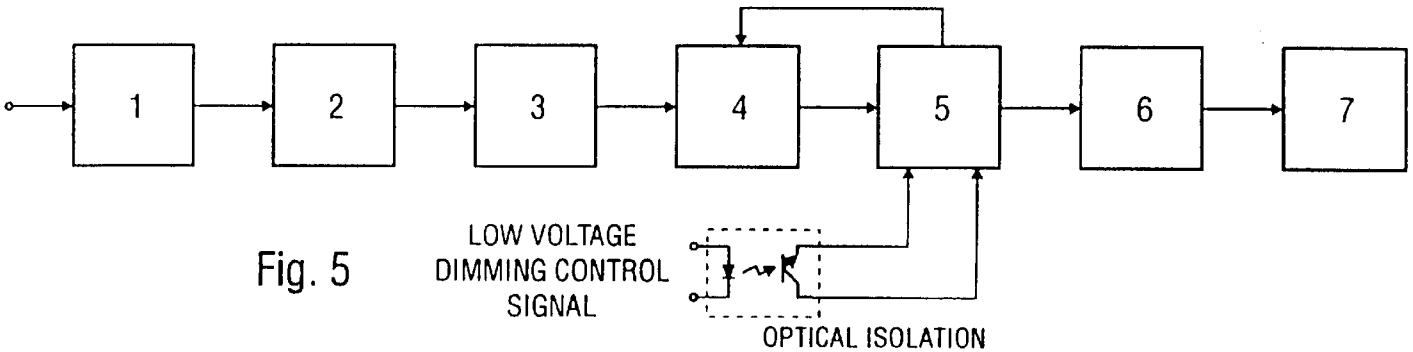
FIG. 5 illustrates the third embodiment of the invention in a similar format as FIG. 2.
Figure 6:
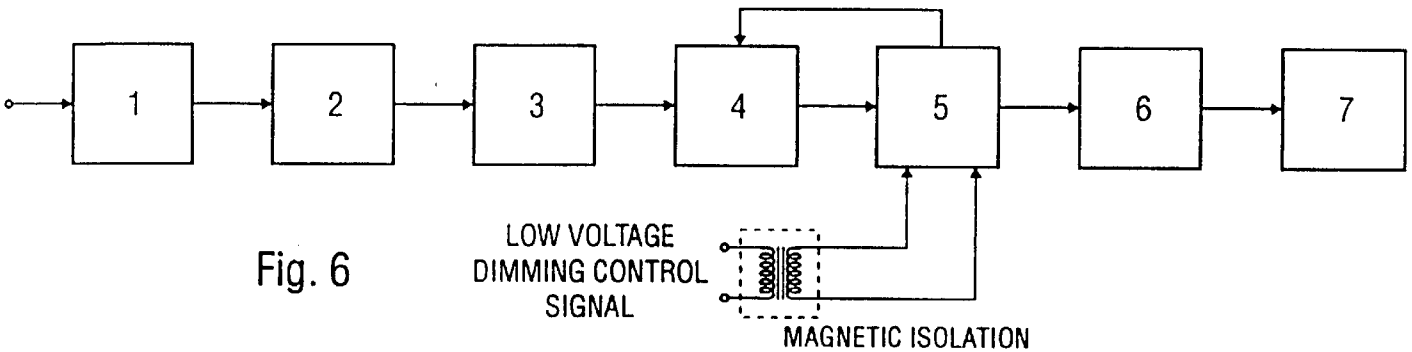
FIG. 6 illustrates the fourth embodiment of the invention in a similar format as FIG. 2.

Referring now in more detail to the drawings, they illustrate a high frequency filtered and dimmable ballast designed to supply power to one or more low-pressure fluorescent lamps of various types and power ratings. The ballast maintains the light output of the lamps essentially constant over a large range of input voltage and frequency without the use of push-pull converter feedback control. This is accomplished through the use of a power factor correction/switching regulator circuit and by resonating the isolated square-wave outputs of the push-pull converter. The power factor correction/switching regulator circuit holds the input to the push-pull converter constant while the series-parallel resonant filters ensure that load changes do not effect the sinusoidal filter outputs and thereby the lamp intensities. The ballast is designed to power the lamps in the dimming or non-dimming mode. In the non-dimming mode, the ballast maintains lamp intensities at 100% of rated (FIGS. 1, 2 and 3). With the addition of suitable dimming devices, connected directly or via optical or magnetic insulation to the push-pull converter control input, the ballasts output can be varied to produce between less-than 10% to 100% of rated lamp intensity (FIGS. 4, 5 and 6). With the addition of a suitable remote switching circuit, the ballast can be switched ON/OFF from a remote location by light, sound or touch (FIG. 7) The power factor correction/switching regulator circuit also keeps the input power factor at greater than 98% and reduces the line total harmonic distortion below 5% while ensuring overall conversion efficiency of better than 90%.

The subsystem blocks of the basic electronic ballast and their designated numbers within the block diagrams in FIGS. 1 through 7 are as 11 listed below.

input protection circuit (1);

RFI filter circuit (2);

full-wave rectifier circuit (3);

power factor correction/switching power supply circuit (4);

push-pull converter circuit (5);

series-parallel resonant filter circuit (6);

electronic lamp load circuit (7).

Figure 8:
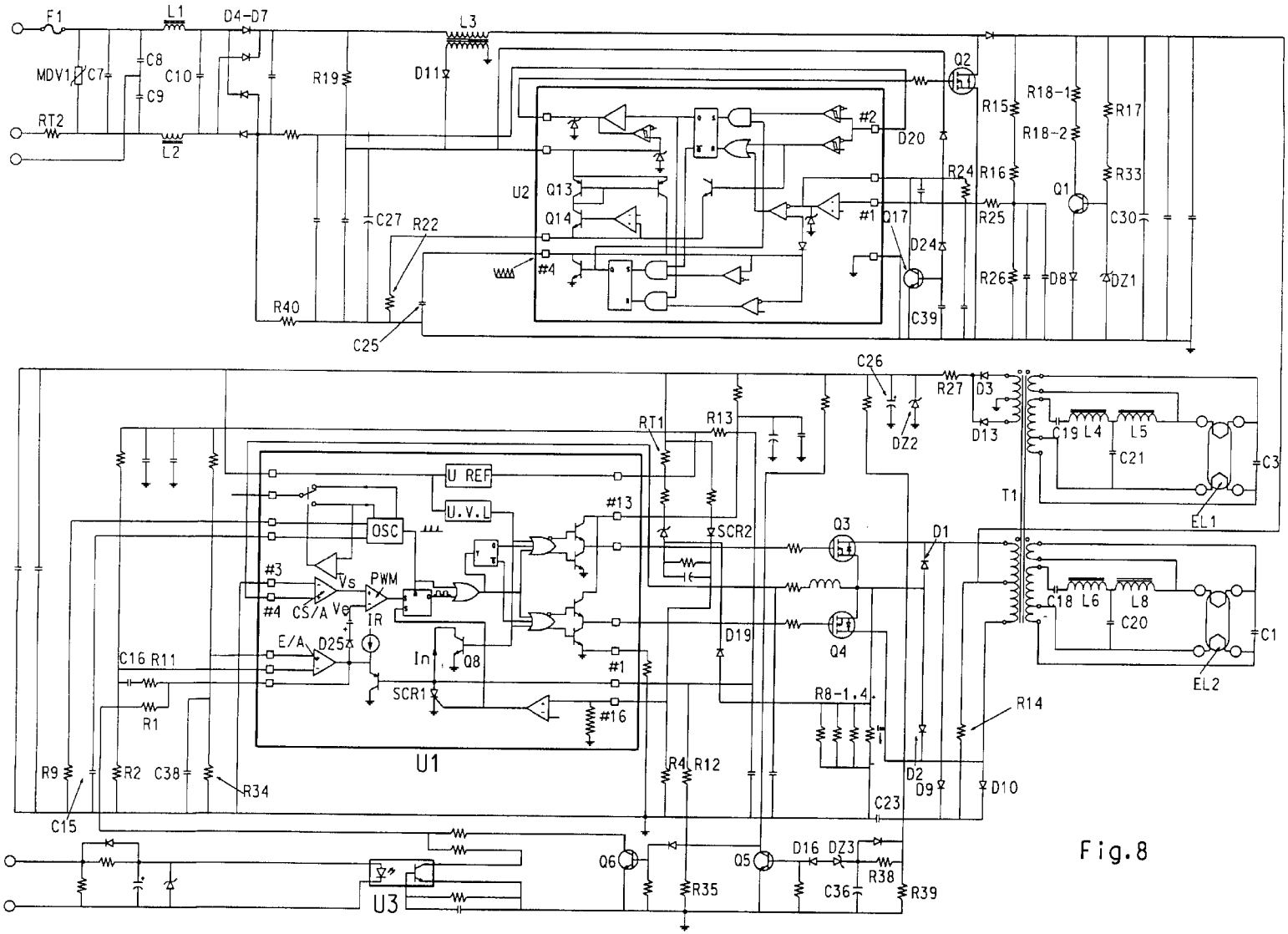
FIG. 8 illustrates the detailed circuit diagram of the electronic circuit according to the invention.

The detailed operational description of circuit operation to follow refers to the circuits as shown on FIG. 8.

In the input protection circuit, the combination of inrush current limiting thermistor RT2, metal oxide varistor MOV1 and input fuse F1 are intended to protect the ballast against excessive inrush current which may damage rectifiers D4–D7, against high-voltage transients which may damage control components and against sustained internal short circuits which could result in destructive damage.

The RFI filter is made up of devices C7, C8, C9, C10, L1 and L2. The filter circuit is intended to reduce conducted RFI, in the range of 0.45 MHz to 30 MHz generated by high-speed switching of inductive components internal to the ballast, from appearing on the ac supply cabling. Since the internal switching circuitry is shielded by the grounded metal enclosure, reducing conducted RFI on the supply leads also results in the virtual elimination of radiated RFI.

In the full-wave rectification circuit diodes D4 through D7 full-wave rectify the 85 to 265 $V_{ac}$ input that appears across C10. The peak value of the unfiltered direct voltage that appears across the input to the power factor correction circuit is in the range of 120 to 373 $V_{dc}$.

The power factor correction circuit is made up of high-frequency series inductor L3, field effect transistor (FET) Q2, control circuit U2, output filter capacitor C30 and various other devices required to start, power, control and protect the power factor correction circuit. The circuit boosts the input direct voltage to 400 $V_{dc}$ and keeps it constant over the rated input voltage and frequency range. Operating Q2 and the rest of the ballast circuits at 400 $V_{dc}$ reduces current flow and minimizes power losses thus improving overall ballast efficiency. Q2 is switched on at the zero crossings of the current waveform through L3. Zero current switching minimizes the reverse recovery losses in rectifiers D4 through D7 thus maximizing their conversion efficiency. The control keeps the switching frequency of Q2 relatively constant during each input half-cycle. It varies Q2 on-time as required during each half-cycle to maintain the power factor correction output voltage constant during rated line voltage and frequency changes.

The power factor correction circuit maintains the input power factor close to unity and the input current waveform sinusoidal as follows:

$$V_{L3}=L3(di/dt)$$

and since, for boost converter operation, $V_{L3}=V_{inst}(t)$ and since, the change in current through L3 is the same as the peak value of the input current (since zero current switching is used) $di=I_{pk}(t)$, and since, L3=C1 and dt=C2 (both can be considered constant during each half-cycle):

$$V_{inst}(t)=(C_1/C_2)^* I_{pk}(t).$$

Accordingly, the current through the inductor at any time during the half-cycle will be in phase with the voltage across the inductor and, since the input voltage across the inductor is sinusoidal, input current will also be sinusoidal. Thus the circuit forces the input current to track the input voltage thereby maintaining close to unity input power factor. It also ensures that the input current remains sinusoidal thereby minimizing input current harmonic distortion.

When ac voltage is applied to the input of the ballast, C27 starts to charge through R19. When the direct voltage across C27 becomes greater than 16 $V_{dc}$ (at approximately 85 $V_{ac}$ input), the circuit starts to operate. If the ac input voltage drops below approximately 55 V, the voltage across C27 will drop to less than 10 $V_{dc}$ and the undervoltage lockout circuit, internal to the control circuit U2, will disable Q2 firing. Inductor L3 is provided with a secondary winding which supplies power to U2 after startup. The high frequency output from the secondary of L3 is rectified with D11 and the resulting direct voltage is filtered by capacitors C3 and C27 to provide ripple free control voltage Vcc to input #7 of U2.

Output voltage is controlled by varying Q2's on-time as follows. The circuit's output voltage appears across the voltage divider network made up of R15, R16 and R26. If the ac input voltage rises, the output direct voltage of the circuit will also tend to rise. This causes the voltage drop across R26 to increase and the voltage at input #1 (VFB) of U2 to increase. $V_{FB}$ is amplified by a factor R24/R25 and the output of the voltage error amplifier E/A is compared with the sawtooth waveform generated at input #4 (RAMP input). The on-time of Q2 is reduced to compensate for the ac input voltage increase If the ac input voltage drops, the ramp on-time will be increased. Accordingly Q2 will remain on for the longest period when the ac input voltage is lowest and will remain on for the shortest period when the ac input voltage is at maximum. The ramp reference waveform's minimum frequency is set to approximately 30 kHz by R22 and C25. Maximum Q2 on-time is therefore limited to approximately 33 microseconds.

U2 is provided with a slow-circuit, made up of Q17, D24, D20 and C39. This circuit minimizes output voltage overshoots and is required to prevent down-stream component damage especially if repetitive stop-starts are expected. Capacitor C39 charges through Q16's base-emitter junction during start-up thereby initially clamping the output voltage of the error amplifier low and than allowing it to rise gradually. This causes the on-time of Q2 to increase slowly and the circuit's output voltage to ramp up. If power is lost (or ac input voltage drops below 55 $V_{ac}$), diode D20 discharges C39 preparing the circuit for the next slow-start.

Output overcurrent protection is provided by sensing the current flow through series resistors R40–R44. The voltage developed across the parallel combination of these resistors appears at input #2 ($I_{SNS}$) of U2 and is internally connected to an overcurrent comparator. If the load current rises above the maximum expected, the comparator will disable Q2 firing and, at the same time, cause a rapid rise in the charging current to C25 thereby forcing Q2 on-time to decrease to zero. This due to the fact that charging time of C25 is set by current through R22 from input #3 ($I_{SET}$) and, if the voltage across R22 rises, current thorough Q13 and Q14 drops while current thorough Q16 increases causing C25 to charge quicker.

The push-pull converter circuit is made up of transformer T1, switching FETs Q3 and Q4, current mode controller U1 and the various auxiliary circuits and components required to start, power, control and protect the circuit. The push-pull converter circuit operates by monitoring and limiting the current flow thorough Q3 and Q4 on a pulse-by-pulse basis. Although pulse width modulation (PWM) control is used, instead of comparing the error voltage to a voltage ramp reference, the pulse width modulation compares the error voltage ($V_e$) to an analog voltage representation of the current thorough the primaries of T1 ($V_s$) This type of peak current sensing allows safer operation of Q3 and Q4 while ensuring that the flux flowing thorough the core of T1 is balanced. Balancing the flux flow reduces the possibility of excessive T1 heating which would result in increased current flow thorough Q3 and Q4, additional heat losses and a general reduction in ballast reliability. Adjustable dead-time, between when one FET turnsoff and the other turns-on, is provided. This ensures that Q3 and Q4 will not be conducting at the same time. In addition, double pulse suppression is used to eliminate consecutive pulsing of the FET gates. Q3 and Q4 are switched at approximately 40 kHz and their on-time can be varied remotely to control the duration that the primary windings of T1 are energized. The circuit incorporates power-on-reset (to block firing until the reference regulator's output voltage is stabilized), slowstart, current limiting and switching device temperature/output shortcircuit protection.

Starting power is supplied to input#13 ($V_c$) of control circuit U1 via a circuit made up of R18-1, R18-2, R17, R33, Q1, DZ1 and D8. The starting voltage to U1 is approximately equal to the voltage across DZ1. Running power is supplied by a set of T1 center-tapped windings (pins #1,2 and 3). The ac output of T1 is rectified by diodes D3 and D13. The resultant direct voltage is filtered with C26. As the push-pull converter circuit starts to operate, the voltage across C26 rises above DZ1 voltage and Q1 turns off. R27 is used the limit control power supply current while DZ2 limits the control voltage. The running power supply reduces transformer switching losses since it converts inductive switching voltage pulses into useful control power.

During startup, silicon controlled rectifier SCR1 (internal to U1) is turned on. With SCR1 on, the output of the voltage error amplifier remains low ensuring that Q3 and Q4 remain turned off. When the input dc voltage to the circuit rises high enough, the U.V lockout circuit turns on Q8 allowing SCR1 to turn off. When SCR1 turns off, the voltage across C38 and the output of the voltage error amplifier rises slow-starting Q3 and Q4. If during normal operation SCR1 is turned on (by the input dc voltage dropping or as a result of protection circuit operation), C38 is discharged and Q3 and Q4 are forced off. Slow-start is reinitiated once the ballast input is turned off then back on.

During non-dimming mode of operation of the output voltage control circuit, the ac output voltage T1 supplies to the series-parallel resonant filters and the filament windings is determined by the input dc voltage at pin #5 of T1 and the on-time of Q3 and Q4. FET on times are determined by the circuit switching frequency and the output voltages from the voltage and current error amplifiers in U1. The non-inverting input of the voltage error amplifier is connected to R34 while its inverting input looks at the voltage across R2. Both the R2 and R34 voltages are constant during normal non-dimming mode operation. The voltage error amplifiers proportional gain is set by RI and integral gain is set by R11 and C16. The inverting input of the current error amplifier is connected to common while its noninverting input connect to the positive voltage side of current sensing resistors R8-1,4 via the filter network made up of R3, L8 and C22. The current error amplifier has a constant gain of times 3. The output of voltage error amplifier ($V_s$) depends on the voltage across R2 while the output of the current error amplifier ($V_s$) depends on the current flowing thorough paralleled resistors R8-1,4. The shape of $V_s$ is dependent on inductive current flowing in T1's windings while $V_e$ is a steady dc voltage level. The two signals are compared by the PWM comparator in U1 and, if $V_s$ rises above $V_e$, the PWM comparator firing is retarded. The output of the PWM comparator sets the PWM latch. The PWM latch is used to control the remaining components of the Q3 and Q4 firing circuit. The PWM comparator corrects for current overshoots on a pulse-by-pulse basis ensuring that the peak currents thorough Q3 and Q4 are kept equal. Q3 and Q4 firing frequency is set by C15, R9 and U1 oscillator (OSC) at approximately of 40 kHz. The voltage across R2 remains constant during the non-dimming mode of operation so that T1's output will remain constant as long as the dc voltage input to T1 remains constant and T1 is not overloaded.

In the dimming mode, the control voltage at input connections #3 and #4 can be varied with various types of remote circuits. If the control voltage is increased, current flow thorough the light emitting diode inside U3 will increase, the light detecting transistor inside U3 will conduct more current and the voltage across R2 will decrease. This will cause voltage error amplifier output V to drop and Q3 and Q4 firing to be advanced. Reducing the control voltage will, in turn, cause Q3 and Q4 firing to advance. When starting the ballast. Q6 is turned on immediately in order to ensure lamp starting with low control voltage input. Q6 pulls the inverting (INV) input of voltage error amplifier low. This causes Q3 and Q4 firing to advance fully for a short time delay (as determined R39, R38, C36, DZ3, D16 and Q5). When the voltage across C36 rises above the breakdown voltage of DZ3, Q5 turns on forcing Q6 to turnoff and Q3/Q4 on-time to be reduced.

In the circuit arrangement there are several other functional units, e.g. overtemperature and overcurrent shutdown and other protective circuits. Shutdown comparator operation is initiated if the voltage at input #16 (SHUTDOWN) of U1 rises above a preset level. This can occur if SCR2 conducts due to FET overtemperature or if the current thorough paralleled sensing resistors R8-1,4 becomes excessive. If FET temperature exceeds the preset level the resistance of thermistor RT1 will drop and DZ4 will conduct sufficient current to trigger-on SCR2. If either Q3 or Q4 conducts excessive current, D19 will conduct and again SCR2 will be turned-on. In either case, the voltage across R4 will rise above the shutdown comparator reference level causing protective shutdown. SCR2 will continue to conduct until the ac input to the ballast is reset. When the ac is turned back on, RT1 will ensure that push-pull converter circuit operation will not start until FET temperatures drop to an acceptable level while the slow-start feature of the push-pull converter circuit will ensure that the FETs are quickly turned-off again if the output is still shortcircuited.

Diodes D1 and D2 are provided to commutate current switching transients away from the source and drain of Q3 and Q4. Switching overvoltages across Q3 and Q4 are limited by the circuit composed of D9, D10, R14 and C23. O9 and D10 become forward biassed when the voltage across one or other winding exceeds the voltage across C23. As the voltage across the winding drops, C23 discharges to the input voltage at pin #5 of T1 in readiness for the next voltage transient.

In the current limit circuit a voltage divider network, made up of R13. R12 and R35, is connected between the regulated 5.1 V output of U1 and common. The voltage across R12 and R35 is sensed by input #1 (Current Limit Input) of U1.

This voltage determines the maximum output value of the voltage error amplifier since if it in less forward biassed and allowing more of the reference current, $I_R$, to flow thorough diode D25 thereby raising $V_e$. During startup, R35 is in the circuit so that the current limit setpoint is raised to accommodate the expected inrush current. After a delay, Q5 turns-on and shunts R35 out of the divider reducing the current limit to just above the normal operating current value.

The output circuits are composed of low-voltage heater windings, high voltage running windings, and series-parallel resonant filters and components required to start ionization.

The low-voltage windings (T1 terminals #7,8, 10, 11, 12, 13, 15 and 16) are used to ensure that each filament is supplied with sufficient current to keep it warm. These windings are energized during the start of push-pull converter circuit operation and preheat the filaments. They ensure correct starting, dimming and help to extend filament lifetimes.

The series-parallel resonant filters are connected between T1's high voltage secondary windings (T1 terminals #8, 9 and 13, 14) and the lamp filaments. The filters are made up of C18, C19, L4, L6, C20, C21, L5 and L8. They ensure that the voltage waveforms between the filaments are maintained essentially sinusoidal even during dimming mode operation. This results in the reduction of load generated harmonics, input power, lamp filament stress and a maximization of light output and operating efficiency. The filters ensure that the load to the push-pull converter circuit remains essentially capacitive therefore no-load to full-load operation is feasible with various types of lamps and the outputs can be opencircuited without damaging the push-pull transistors in the push-pull converter circuit. The filter output impedances are substantially the same as their input impedances and, since their input impedances are very low (essentially short-circuits), short-circuiting their outputs will provide sufficient current flow in the primaries of T1 to ensure that ballast protective circuits can operate correctly.

The lamps are started with the capacitors connected between the lamp filaments (C1 and C3). On startup, the ac voltages across the filter outputs will tend to rise slowly. When these voltages are sufficiently high, C1 and C3 start to resonate with L7 and L5 thereby providing the initial high-voltages required to start conduction between the filaments.

While there has been shown and described what is considered to be a preferred embodiment of the invention, it will, of coarse, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A high-frequency filtered dimmable electronic ballast circuit for powering low-pressure fluorescent lamps, comprising:

(a) an input protection means;

(b) a radio-frequency filter means connected to an output of the input protection means;

(c) a rectifier means connected to an output of said radio-frequency filter means;

(d) a power factor correcting switching power supply means connected to an output of said rectifier means;

(e) a current controlled push-pull converter means connected to an output of the switching power supply means;

(f) a series-parallel resonant filter composed of a capacitor in series with two inductors having a common connection in parallel with an additional capacitor means connected to an output of the push-pull converter means to maintain voltage wave forms essentially sinusoidal and of constant amplitude regardless of loading;

(g) a fluorescent lamp connected to an output of the resonant filter; and (h) an external on/off switching circuit means connected directly or by one of an optical and magnetic insulation means to an input of said push-pull converter means for remotely turning on and off said fluorescent lamp.

2. An electronic ballast circuit as claimed in claim 1 wherein the current-controlled push-pull converter means is a transformer equipped with more than one secondary windings means and the secondary winding means are each connected to series-parallel resonant filter means and these filter means are each used to power fluorescent lamp means to allow to ballast to simultaneously power more than one fluorescent lamp.

3. An electronic ballast circuit as claimed in claim 1 wherein an external low voltage signal is connected directly to an input of the current-controlled push-pull converter means in order to make dimming of one or more fluorescent lamps possible.

4. An electronic ballast circuit as claimed in claim 1 wherein an external low voltage signal is connected via optical insulation means to an input of the current-controlled push-pull converter means in order to make dimming of one or more fluorescent lamps possible.

5. An electronic ballast circuit as claimed in claim 1 wherein an external low voltage signal is connected via magnetic insulation means to an input of the current-controlled push-pull converter means in order to make dimming of one or more fluorescent lamps possible.

6. An electronic ballast circuit as claimed in claim 1 wherein input and output overvoltage and short circuit protection, overtemperature protection, radio-frequency interference (RFI) filtering, input power factor and harmonic distortion correction and soft-starting circuit are provided.

* * * * *